US007556084B2

(12) United States Patent
Bowman et al.

(10) Patent No.: US 7,556,084 B2
(45) Date of Patent: Jul. 7, 2009

(54) LONG WEAR SIDE DAMS

(75) Inventors: Brian E. Bowman, Waveland, IN (US); Alan J. Deno, Jamestown, IN (US); Gordon D. Emmert, Crawfordsville, IN (US)

(73) Assignee: Nucor Corporation, Charlotte, NC (US)

( * ) Notice: Subject to any disclaimer, the term of this patent is extended or adjusted under 35 U.S.C. 154(b) by 0 days.

(21) Appl. No.: 11/277,414

(22) Filed: Mar. 24, 2006

(65) Prior Publication Data

US 2007/0221358 A1 Sep. 27, 2007

(51) Int. Cl.
*B22D 11/06* (2006.01)

(52) U.S. Cl. ..... 164/428

(58) Field of Classification Search ..... 164/442, 164/448, 480, 428

See application file for complete search history.

(56) References Cited

U.S. PATENT DOCUMENTS

| | | | | |
|---|---|---|---|---|
| 4,723,590 | A | 2/1988 | Yamauchi et al. | |
| 4,811,780 | A | 3/1989 | Yamauchi et al. | |
| 4,869,310 | A | 9/1989 | Yanagi et al. | |
| 5,058,657 | A | 10/1991 | Hasegawa et al. | |
| 5,060,714 | A * | 10/1991 | Yamauchi et al. | 164/428 |
| 5,201,362 | A * | 4/1993 | Yamagami et al. | 164/480 |
| 5,207,265 | A | 5/1993 | Hasegawa et al. | |
| 5,437,325 | A * | 8/1995 | Legrand et al. | 164/428 |
| 5,584,335 | A | 12/1996 | Barbe et al. | |
| 5,588,479 | A | 12/1996 | Leadbeatter et al. | |
| 5,638,892 | A * | 6/1997 | Barbe et al. | 164/452 |
| 5,787,968 | A | 8/1998 | Lauener | |
| 5,810,070 | A | 9/1998 | Osada et al. | |
| 5,915,454 | A * | 6/1999 | Wright et al. | 164/428 |
| 5,927,375 | A | 7/1999 | Damasse et al. | |
| 5,964,276 | A | 10/1999 | Dompas et al. | |
| 6,032,722 | A | 3/2000 | Russell et al. | |
| 6,145,581 | A | 11/2000 | Takeuchi et al. | |
| 6,202,792 | B1 | 3/2001 | Cheong et al. | |
| 6,237,673 | B1 | 5/2001 | Kato et al. | |
| RE37,214 | E | 6/2001 | Barbe et al. | |
| 6,296,046 | B1 | 10/2001 | Jeong et al. | |
| 6,354,365 | B2 * | 3/2002 | Capotosti et al. | 164/480 |
| 6,739,382 | B2 | 5/2004 | DeLuca et al. | |
| 2002/0079390 | A1 | 6/2002 | Jungling et al. | |

(Continued)

FOREIGN PATENT DOCUMENTS

| | | |
|---|---|---|
| EP | 967032 | 12/1999 |

(Continued)

OTHER PUBLICATIONS

Notification of Co-pending Applications.

(Continued)

*Primary Examiner*—Kevin P Kerns
(74) *Attorney, Agent, or Firm*—Hahn Loeser & Parks

(57) ABSTRACT

The method of producing thin cast strip by continuous casting having a side dam assembly. The side dam assembly includes a side dam having opposite outer surfaces, one surface contacting molten metal and the opposite outer surface having fastening portions capable of attaching the side dam to a side dam holder, to hold the side dam in place during casting without exposed portions of the side dam holder extending substantially beyond the opposite outer surface toward the outer surface for contacting molten metal.

19 Claims, 11 Drawing Sheets

U.S. PATENT DOCUMENTS

| | | | |
|---|---|---|---|
| 2006/0054298 | A1 | 3/2006 | Hohenbichler et al. |
| 2006/0081352 | A1 | 4/2006 | Damasse et al. |
| 2006/0102312 | A1 | 5/2006 | Poloni et al. |
| 2006/0118271 | A1 | 6/2006 | Cooper et al. |

FOREIGN PATENT DOCUMENTS

| | | |
|---|---|---|
| GB | 2296883 | 7/1996 |
| GB | 2337016 | 11/1999 |
| JP | 61-042454 | 2/1986 |
| JP | 61-144245 | 7/1986 |
| JP | 62-064456 | 3/1987 |
| JP | 02-099244 | 4/1990 |
| JP | 2000-000641 | 1/2000 |
| WO | 2004/007113 | 1/2004 |

OTHER PUBLICATIONS

ISR for PCT/AU2007/000351.
Written Opinion for PCT/AU2007/000351.

* cited by examiner

LONG WEAR SIDE DAMS

BACKGROUND OF THE INVENTION

In the continuous casting method of manufacturing steel, molten (liquid) steel is cast directly into thin strip by a casting machine. The shape of the strip is determined by the mold of the casting machine, which receives the molten metal from a tundish and casts the metal into thin strip. The strip may be further subjected to cooling and processing upon exit from the casting rolls.

In a twin roll caster, molten metal is introduced between a pair of counter-rotated horizontal casting rolls which are internally cooled so that metal shells solidify on the moving casting roll surfaces, and are brought together at the nip between the casting rolls to produce a thin cast strip product, delivered downwardly from the nip between the casting rolls. The term "nip" is used herein to refer to the general region at which the casting rolls are closest together. The molten metal may be poured from a ladle through a metal delivery system comprised of a tundish and a core nozzle located above the nip, to form a casting pool of molten metal supported on the casting surfaces of the rolls above the nip and extending along the length of the nip. This casting pool is usually confined between refractory side plates or dams held in sliding engagement with the end surfaces of the casting rolls so as to restrain the two ends of the casting pool.

When casting steel strip in a twin roll caster, the thin cast strip leaves the nip at very high temperatures, of the order of 1400° C. If exposed to normal atmosphere, it will suffer very rapid scaling due to oxidation at such high temperatures. A sealed enclosure that contains an atmosphere that inhibits oxidation of the strip is therefore provided beneath the casting rolls to receive the thin cast strip, and through which the strip passes away from the strip caster. The oxidation inhibiting atmosphere may be created by injecting a non-oxidizing gas, for example, an inert gas such as argon or nitrogen, or combustion exhaust reducing gases. Alternatively, the enclosure may be substantially sealed against ingress of an ambient oxygen-containing atmosphere during operation of the strip caster, and the oxygen content of the atmosphere within the enclosure reduced during an initial phase of casting, by allowing oxidation of the strip to extract oxygen from the sealed enclosure as disclosed in U.S. Pat. Nos. 5,762,126 and 5,960,855.

The length of a casting campaign of a twin roll caster has been generally determined in the past by the wear cycle on the core nozzle, tundish and side dams. Multi-ladle sequences can be continued so long as the source of hot metal supplies ladles of molten steel, by use of a turret on which multiple ladles of molten metal can be transferred to operating position. Therefore, the focus of attention in the casting has been extending the life cycle of the core nozzle, tundish and side dams, and thereby reducing the cost per ton of casting thin strip. When a nozzle, tundish or side dam would wear to the point that one of them had to be replaced, the casting campaign would have to be stopped, and the worn out component replaced. This would generally require removing other unworn components as well since otherwise the length of the next campaign would be limited by the remaining useful life of the worn but not replaced refractory components, with attendant waste of useful life of refractories and increased cost of casting steel. Further, all of the refractory components, both replaced and continued components, would have to be preheated the same as starting the original casting campaign before the next casting could be done. Graphitized alumina, boron nitride and boron nitride-zirconia composites are examples of suitable refractory materials for the side dams, tundish and core nozzle components. Also, since the core nozzle, tundish and side dams all have to be preheated to very high temperatures approaching that of the molten steel to withstand contact with the molten steel over long periods, considerable waste of casting time between campaigns resulted. See U.S. Pat. Nos. 5,184,668 and 5,277,243.

Also, the side dams wear independently of the core nozzles and tundish, and independently of each other. The side dams must initially be urged against the ends of the casting rolls under applied forces, and "bedded in" by wear so as to ensure adequate seating against outflow of molten steel from the casting pool. The forces applied to the side dams may be reduced after an initial bedding-in period, but will always be such that there is significant wear of the side dams throughout the casting operation. For this reason, the core nozzle and tundish components in the metal delivery system could have a longer life than the side dams, and could normally continue to be operated through several more ladles of molten steel supplied in a campaign if the useful life of the side dams could be extended. The tundish and core nozzle components, which still have useful life, are often changed when the side dams are changed to increase casting capacity of the caster. Further, the core nozzle must be put in place before the tundish, and conversely the tundish must be removed before core nozzle can be replaced, and both of these refractory components wear independently of each other.

In addition, no matter which refractory component wears out first, a casting run will need to be terminated to replace the worn out component. Since the cost of thin cast strip production is directly related to the length of the casting time, unworn components in the metal delivery system are generally replaced before the end of their useful life is a precaution to avoid further disruption of the next casting campaign. This results in attendant waste of useful life of refractory components.

Each side dam is generally held in place during casting by a side dam holder. The side dam typically includes a V-shaped beveled bottom portion and the side dam holder typically includes a V-shaped receptacle into which the V-shaped beveled bottom portion of the side dam is seated. The V-shape configuration serves to position and hold the side dam in place during casting. However, such side dam assemblies limit the useful life of the side dams before adversely impacting the edges of the cast strip and risking serious damage to the casting equipment. Specifically, the worn side dams and side dam holders may allow bleeding molten metal if the side dams are allowed to wear past a certain point, and result in damage to the casting equipment. Therefore, the side dams are usually replaced before such damage to the edges of the cast strip and to casting equipment can occur limiting the duration of the casting campaign. As explained above, when the side dams are changed, the removable tundish and nozzle core will generally also be changed and a new casting campaign started. The casting costs per ton of thin strip cast thus could be considerably reduced if the useful life of the side dams could be extended.

Further limitations and disadvantages of previously used and proposed thin strip casting systems and methods will become apparent to one of skill in the art, through comparison of such systems and methods with the present invention as set forth in this present application.

SUMMARY OF THE INVENTION

A method of producing thin cast strip by continuous casting is disclosed comprising the steps of:

a) assembling a pair of casting rolls having a nip therebetween;

b) assembling a metal delivery system comprising side dams adjacent the ends of the nip to confine a casting pool of molten metal supported on casting surfaces of the casting rolls, where each side dam has opposite outer surface portions one contacting the molten metal and the other having fastening portions capable of attaching the side dam to a side dam holder to hold said side dams in place during casting, without any exposed portion of said side dam holder extending substantially beyond said opposite outer surface of said side dam toward the outer surface contacting the molten metal;

c) introducing molten steel between the pair of casting rolls to form a casting pool supported on casting surfaces of the casting rolls confined by said side dams; and d) counter-rotating the casting rolls to form solidified metal shells on the surfaces of the casting rolls and cast thin steel strip through the nip between the casting rolls from said solidified shells The fastening portions of each side dam may comprise refractory fasteners extending beyond said opposite outer surface adjacent to a side dam holder. These refractory fasteners of each side dam and attachment portions of each side dam holder may interact to position the side dam for casting. Said fastening portions of each side dam may comprise ceramic pins which are attached into said opposite outer surface portion of each side dam.

Each side dam holder may have attachment portions comprising notches, or troughs, into which fastening portions of the side dam can seat, when the side dam is attached to the side dam holder during a casting campaign. Alternatively, the side dam holder may have attachment portions, which are usually ceramic, that extend into the fastening portions of the side dams (which are openings in the side dam), so that the exposed portions of the side dam holder do not extend substantially beyond the opposite outer side surface of the side dam toward the outer surface contacting the molten metal.

A continuous thin strip casting system is also disclosed with side dam assemblies at each side of the caster. Each side dam assembly comprises a side dam having opposite outer surfaces, one of contacting molten metal and the opposite outer surface having fastening portions capable of attaching and holding the side dam in place during casting. The side dam assembly further may comprise a side dam holder having attachment portions capable of receiving and supporting the side dam at the fastening portions without any exposed portion of the side dam holder extending substantially beyond the opposite outer surface portion of the side dam toward the surface portion for contacting molten metal.

The side dam assembly may comprise a side dam having at least three ceramic pins extending outward from the opposite outer surface capable of attaching to the attachment portions of the side dam holder and holding the side dam in place during casting. The side dam assembly also may comprise a side dam holder having notches, or troughs, capable of positioning and supporting the side dam during casting, without any exposed portion of the side dam holder extending substantially beyond the opposite outer surface of the side dam toward the surface portion of the side dam for contacting molten metal.

The system and method of continuously casting thin strip, with the disclosed side dam assembly, can extend the length of a casting campaign by as much as 50%, or more. The useful life of the side dams can be extended without risk of bleeding of molten metal from the casting pool at a side dam causing damage to the edges of the cast strip and resulting in termination of the casting sequence. Further, risk of damage to the casting equipment from bleeding of molten metal at the side dams is substantially reduced. Also, with certain embodiments of the present invention, the positioning of the side dams after preheating by robots is facilitated by assembling the side dams in place for casting. These and other advantages and novel features of the present invention, as well as details of an illustrated embodiment thereof, will be more fully understood from the following description and drawings.

DETAILED DESCRIPTION OF THE INVENTION

Figure 1A:
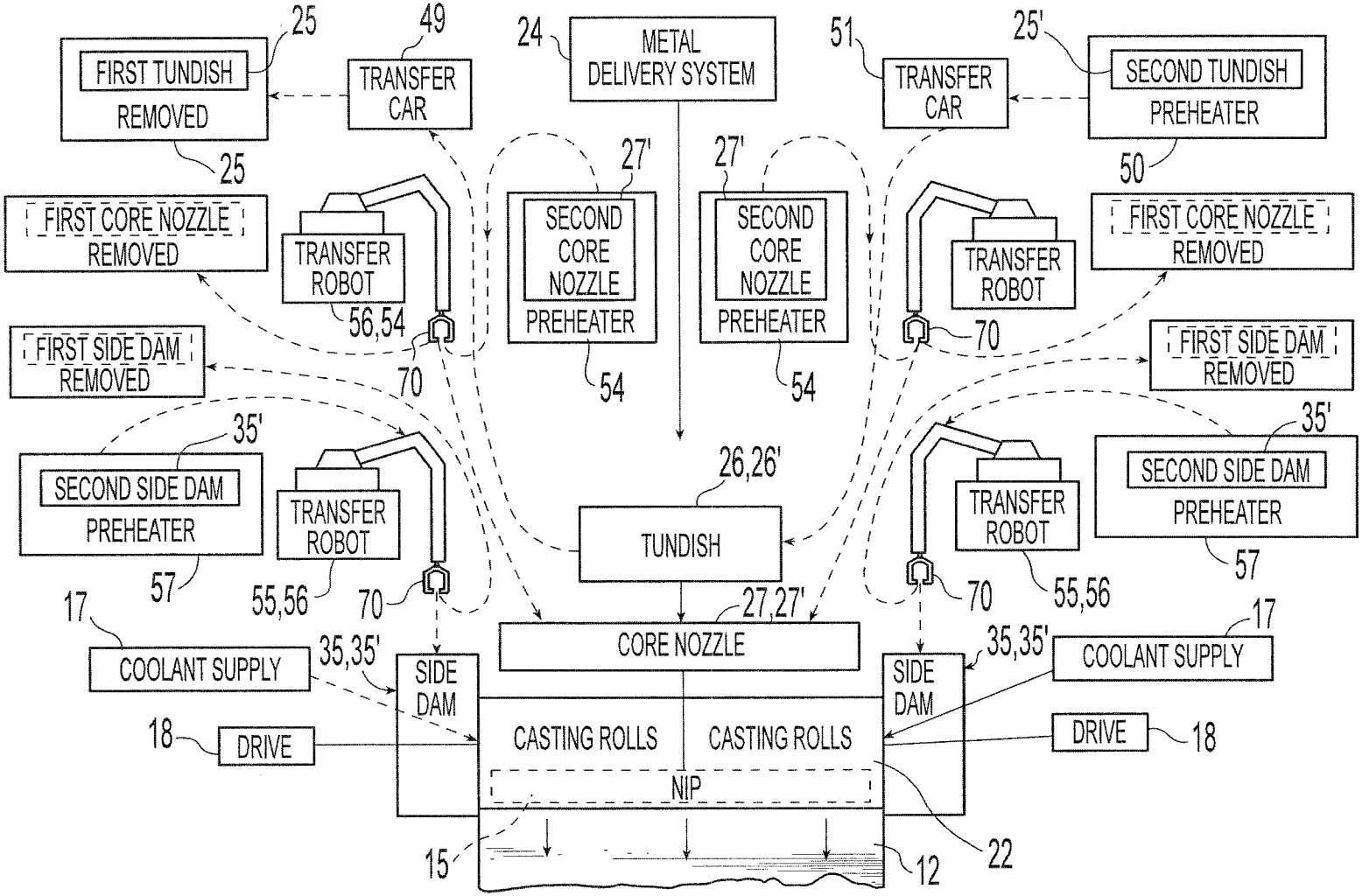
FIGS. 1A-1G illustrate various aspects of an exemplary continuous twin roll caster system in which embodiments of the present invention are used, in accordance with various aspects of the present invention.

FIGS. 1A-1G illustrate various aspects of an exemplary continuous twin roll caster system in which embodiments of the present invention are used, in accordance with various aspects of the present invention.

The illustrative twin roll caster comprises a twin roll caster denoted generally as 11 producing a cast steel strip 12 which passes within a sealed enclosure 10 to a guide table 13, which guides the strip to a pinch roll stand 14 through which it exits the sealed enclosure 10. The seal of the enclosure 10 may not be complete, but appropriate to allow control of the atmosphere within the enclosure and access of oxygen to the cast strip within the enclosure as hereinafter described. After exiting the sealed enclosure 10, the strip may pass through other sealed enclosure and may be subjected to in-line hot rolling and cooling treatment forming no part of the present invention.

Twin roll caster 11 comprises a pair of laterally positioned casting rolls 22 forming a nip 15 therebetween, to which molten metal from a ladle 23 is delivered through a metal delivery system 24. Metal delivery system 24 comprises a tundish 25, a removable tundish 26 and one or more core nozzles 27 which are located above the nip 15. The molten metal delivered to the casting rolls is supported in a casting pool 16 on the casting surfaces of the casting rolls 22 above the nip 15.

The casting pool of molten steel supported on the casting rolls is confined at the ends of the casting rolls 22 by a pair of first side dames 35, which are applied to stepped ends of the rolls by operation of a pair of hydraulic cylinder units 36 acting through thrust rods 50 connected to side dam holders 37.

The casting rolls 22 are internally water cooled by coolant supply 17 and driven in counter rotational direction by drives 18, so that metal shells solidify on the moving casting roll surfaces as the casting surface move through the casting pool 16. These metal shells are brought together at the nip 15 to produce the thin cast strip 12, which is delivered downwardly from the nip 15 between the rolls.

Figure 1B:
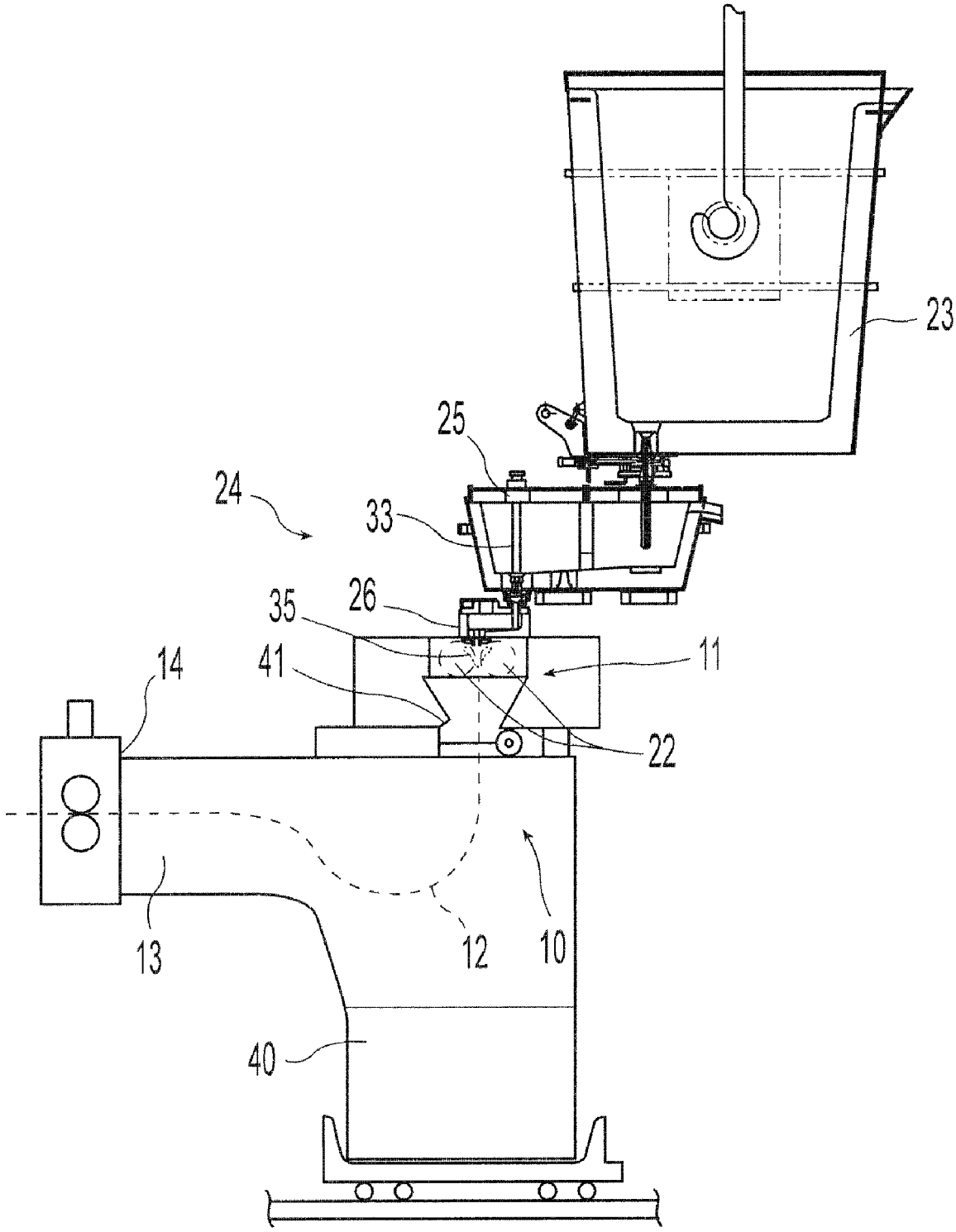
Figure 1C:
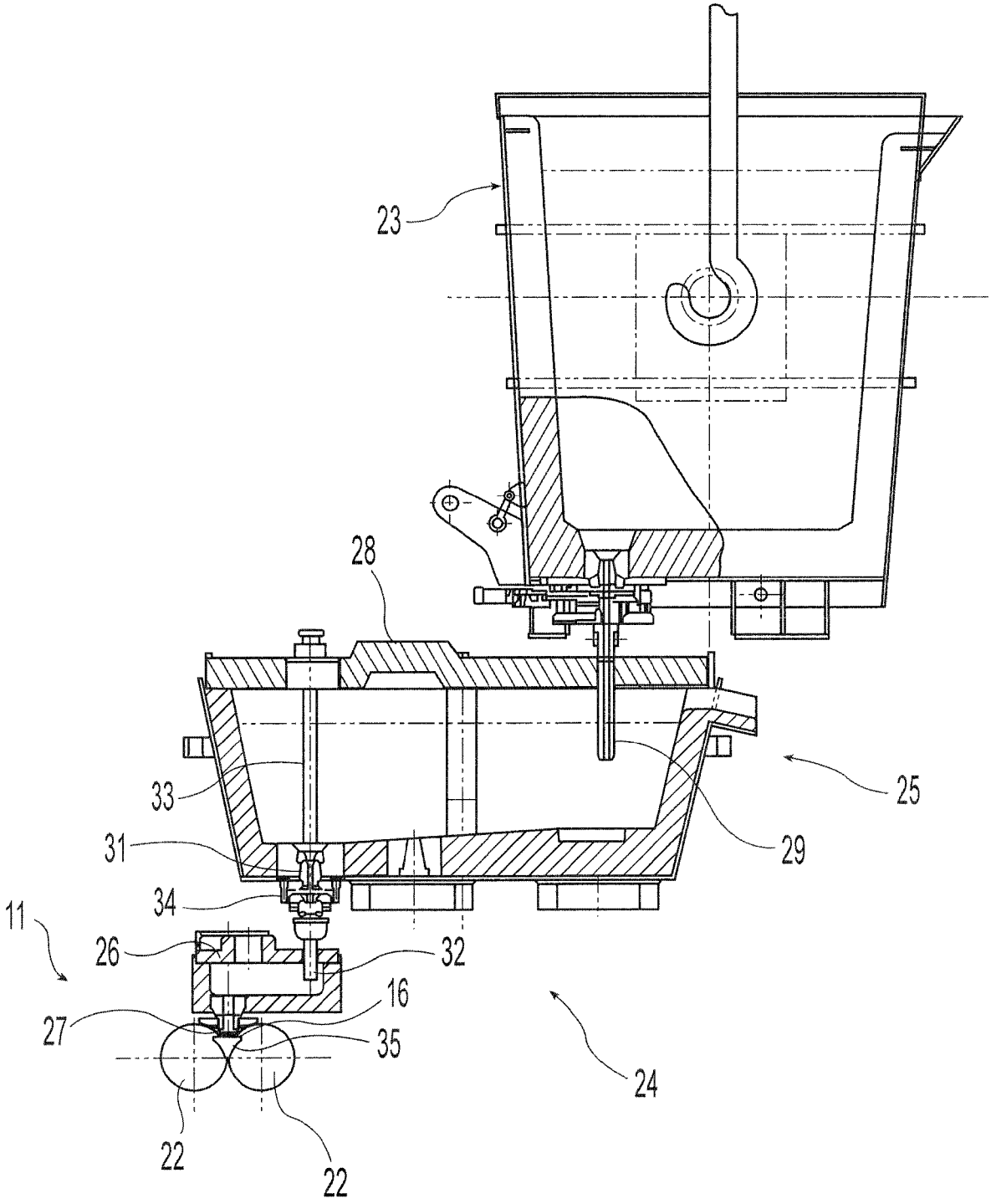
Figure 1D:
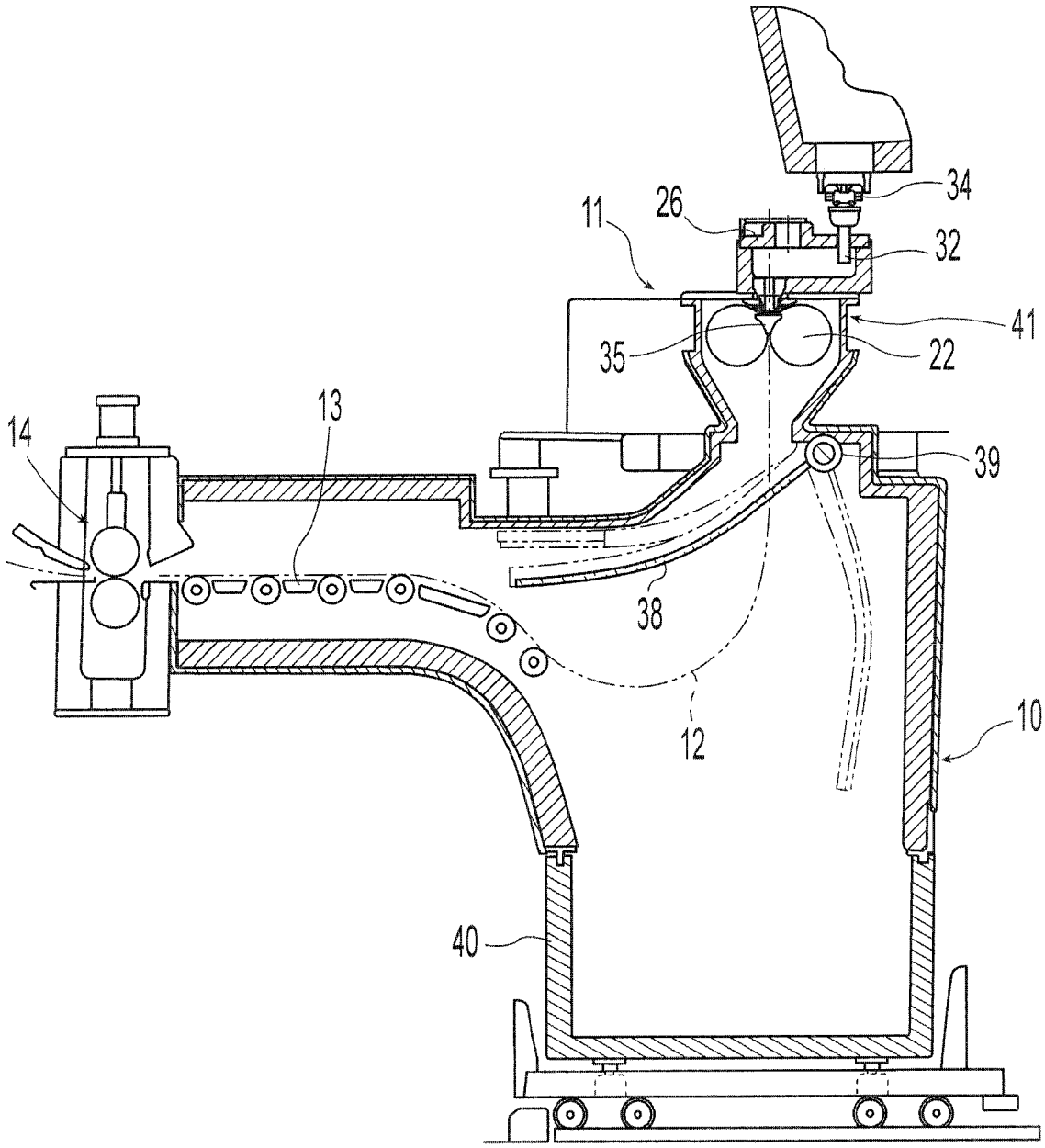
Figure 1E:
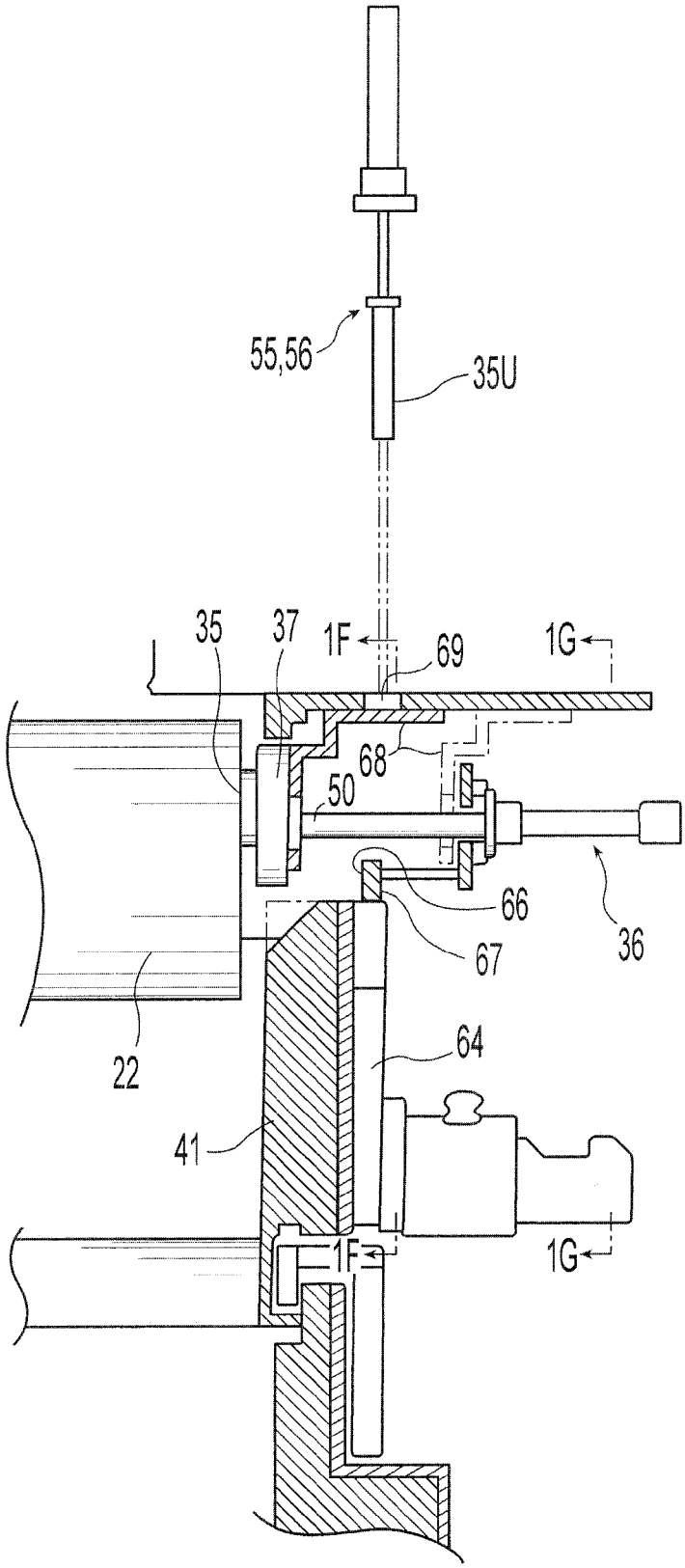
Figure 1F:
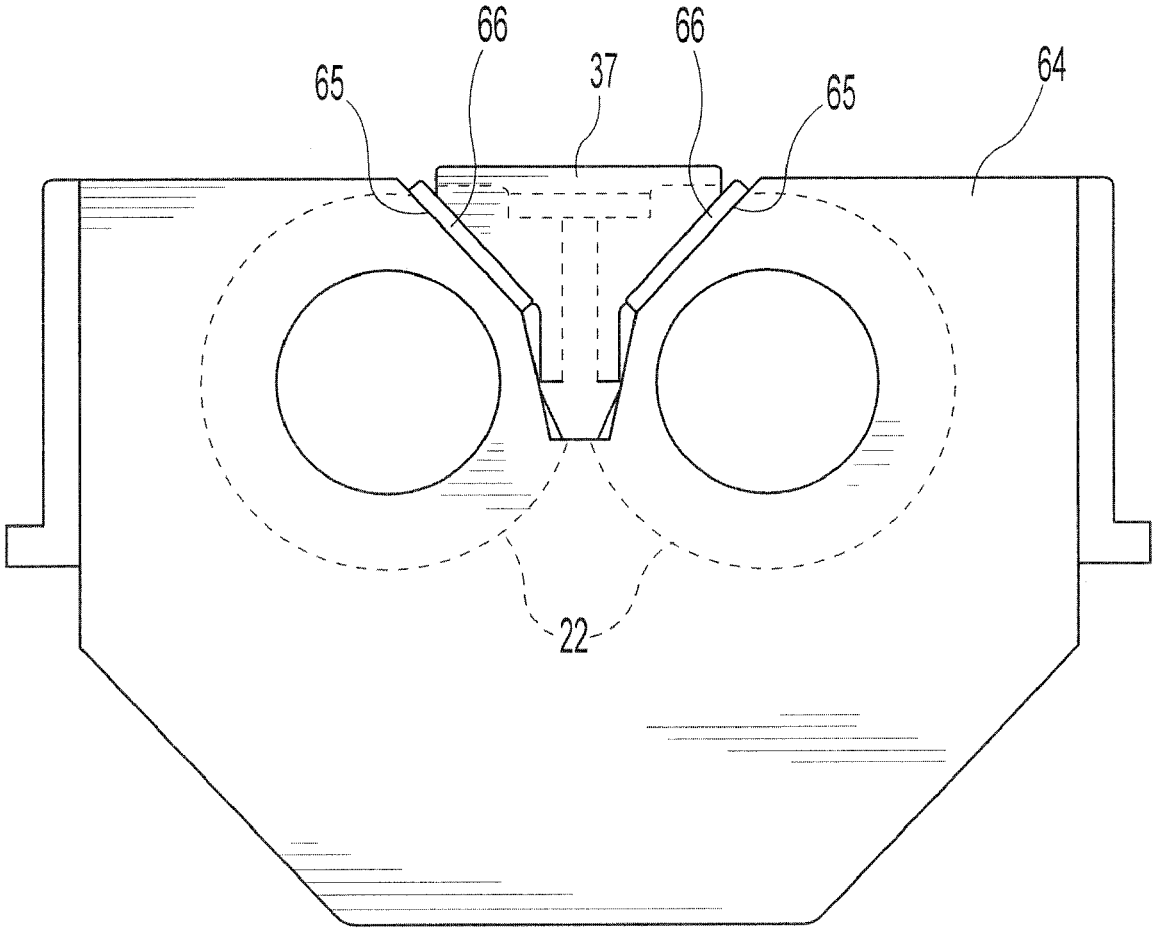
Figure 1G:
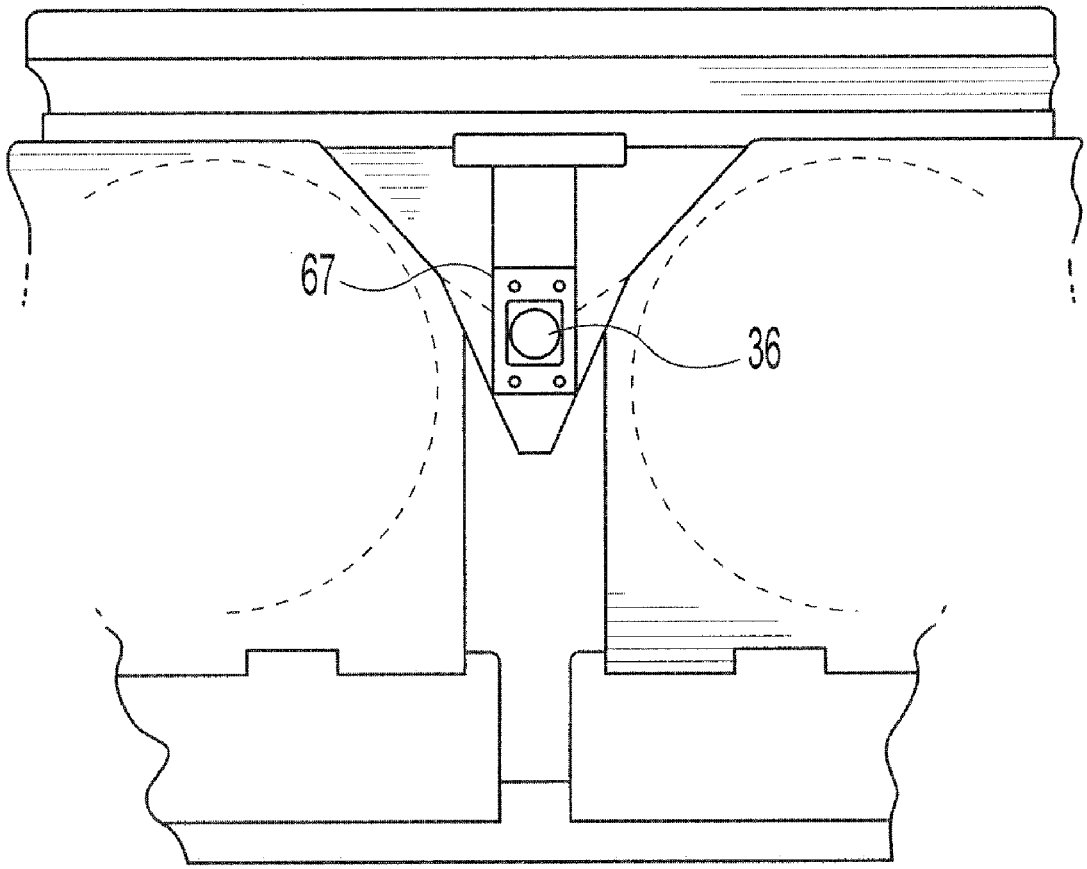

Tundish 25 is fitted with a lid 28. Molten steel is introduced into the tundish 25 from ladle 23 via an outlet nozzle 29. The tundish 25 is fitted with a stopper rod 33 and a slide gate valve 34 to selectively open and close the outlet 31 and effectively control the flow of metal from the tundish to the removable tundish 26. The molten metal flows from tundish 25 through an outlet 31 through an outlet nozzle 32 to removable tundish 26, (also called the distributor vessel or transition piece), and then to core nozzles 27. At the start of a casting operation a short length of imperfect strip is produced as the casting conditions stabilize. After continuous casting is established, the casting rolls are moved apart slightly and then brought together again to cause this leading end of the strip to break away so as to form a clean head end of the following cast strip to start the casting campaign. The imperfect material drops into a scrap box receptacle 40 located beneath caster 11 and forming part of the enclosure 10 as described below. At this time, swinging apron 38, which normally hangs downwardly from a pivot 39 to one side in enclosure 10, is swung across the strip outlet from the nip 15 to guide the head end of the cast strip onto guide table 13, which feeds the strip to the pinch roll stand 14. Apron 38 is then retracted back to its hanging position to allow the strip to hang in a loop beneath the caster, as shown in FIGS. 1B and 1D, before the strip passes to the guide table where it engages a succession of guide rollers.

The twin roll caster illustratively may be of the kind which is illustrated in some detail in U.S. Pat. Nos. 5,184,668 and 5,277,243, and reference may be made to those patents for appropriate constructional details which form no part of the present invention.

The first enclosure wall section 41 surrounds the casting rolls 22 and is formed with side plates 64 provided with notches 65 shaped to snugly receive the side dam plate holders 37 when the pair of side dams 35 are pressed against the ends of casting rolls 22 by the cylinder units 36. The interfaces between the side dam holders 37 and the enclosure side wall sections 41 are sealed by sliding seals 66 to maintain sealing of the enclosure 10. Seals 66 may be formed of ceramic fiber rope or other suitable sealing material.

The cylinder units 36 extend outwardly through the enclosure wall section 41, and at these locations the enclosure is sealed by sealing plates 67 fitted to the cylinder units so as to engage with the enclosure wall section 41 when the cylinder units are actuated to press the pool closure plates against the ends of the casting rolls. Cylinder units 36 also move refractory slides 68 which are moved by the actuation of the cylinder units to close slots 69 in the top of the enclosure, through which the side dams 35 are initially inserted into the enclosure 10 and into the holders 37 for application to the casting rolls. The top of the sealed enclosure 10 is closed by the tundish 26, the side dam holders 37 and the slides 68 when the cylinder units are actuated to urge the side dams 35 against the casting rolls 22.

When it is determined that a change has to be made in the side dams 35, core nozzle 27 or removable tundish 26 due to wear or any another reason, preheating is commenced of a second refractory component identified to be in need of replacement. This preheating of the second tundish 26' or second core nozzle 27' is started while casting is continuing at least 2 hours before transfer to the operating position, and the preheating of the second side dams 35' is started at least 0.5 hours before transfer to the operating position. This preheating is done in a preheating heater 50, 54 or 57, typically a preheating chamber, in a location convenient to the caster 11, but removed from the operating position of the refractory components during casting.

During this preheating of the replacement refractory component, casting typically continues without interruption. When the refractory component to be replaced, namely, the tundish 26, the core nozzle 27 or the side dams 35, the slide gate 34 is closed and the tundish 26, the core nozzle 27 and the casting pool 16 are is drained of molten metal. Typically, the tundish 26', and side dams 35' are preheated and replaced as individual refractory components, and the core nozzle is preheated and replaced as a singular or two piece refractory component, but in particular embodiments may be preheated and replaced in pieces or parts as those portions of the refractory component are worn.

When it is determined that a change has to be made in the side dams 35 due to wear or any another reason, preheating is begun of one or more second side dams 35' identified to be in need of replacement as casting continues. This preheating of the second side dams 35' is started at least 0.5 hours before transfer to the operating position. During this preheating of the replacement refractory component, casting is typically continued without interruption. When the preheating is completed and the change in side dams is to take place, the slide gate 34 is closed and the tundish 26, core nozzle 27 and casting pool 16 are drained and the casting is interrupted. A pair of transfer robots 55 remove the first side dams 35 from the operating position, and then a pair of transfer robots 56 transfer the second side dams 35 40 from the preheating chamber 57 to the operating position. Note that transfer robots 55 and 56 may be the same as shown in FIG. 1A if there is a place for the transfer robots to rapidly set aside the removed first side dams 35. However, to save time in removing the side dams 35 and positioning the second side dams 35' in the operating position, two pairs of transfer robots 55 and 56 may be employed. Following positioning of the second side dams 35' in the operating position, the side gate 34 is opened to fill the tundish 26 and core nozzle 27 and form casting pool 16, and continue casting. Note that transfer robots 56 and 56 may be the same transfer robots 52 and 53, used to transfer the core nozzles, fitted with a second set gripper arms 71.

Each transfer robot 52, 53, 55 and 56 is a robot device known to those skilled in the art with gripping arms 70 to grip the core nozzle 27 or 27' typically in two parts, or side dams 35 or 35'. They can be raised and lowered and also moved horizontally along overhead tracks to move the core nozzle 27' or the side dams 35 from a preheating chamber 54 or 57 at a separate location from the operating position to the caster for downward insertion of the plates through the slots 69 into the holders 37. Gripper arms 70 are also operable to remove at least portions of worn core nozzle 27 or side dams 35. The step of removing the worn side dam 35 is done by operating cylinder unit 36 to withdraw the thrust rod 36 sufficiently to open the slot 69 and to bring side dam 35 into position directly beneath that slot, after which the gripping arm 70 of the transfer robot 55 can be lowered through the slot to grip the side dam 35 and then raised to withdraw the worn side dam. The side dams 35 may be removed when they become worn to specified limits as will be explained further below, and may be removed one at a time as worn to a specified limit. During a casting run and at a time interval before the side dams 35 have worn down to an unserviceable level, the wear rate of the side dams 35 may be monitored by sensors, and the preheating of replacement side dams 35' is commenced in preheat furnaces at preheating chamber 57 separate from the caster 11.

To change the side dams 35, when the molten steel has drained from the metal delivery system and casting pool, cylinder units 36 are operated to retract the side dam holders 37 and to bring the dam sides 35 directly beneath the slots 69 which are opened by the retraction movement of the slides 68. Transfer robots 55 may then be lowered such that their gripping arms 70 can grip the side dams 35 and raised and remove those worn side dams, which can then be dumped for scrap or refurbishment. The transfer robots 56 are then moved to the preheat chambers where they pick up the replacement side dams 35' and move them into position above the slots 69 and the retracted side dam holders 37. Side dams 35' are then lowered by the transfer robots 56 into the plate holders, the transfer robots 56 are raised and the cylinder units 36 operated to urge the preheated replacement side dams 35 40 against the end of the casting rolls 22 and to move the slides 68 to close the enclosure slots 69. The operator then actuates slide gate 34 to initiate resumption of casting by pouring molten steel into tundish 26 and core nozzle 27, to initiate a normal casting operation in a minimum of time.

It may be desirable to replace a side dam or dams 35 when worn to specified limits, such as when the dam(s) become or will become unserviceable. For example, the wear of the side dams may be monitored by means of load/displacement transducers mounted on cylinders 36. The cylinders will generally be operated so as to impose a relatively high force on the side dams 35 during an initial bedding-in period in which there will be a higher wear rate after which, the force may be reduced to a normal operating force. The output of the displacement transducers on cylinders 36 can then be analyzed by a control system, usually including a computerized circuit, to establish a progressive wear rate and to estimate a time at which the wear will reach a level at which the side plates become unserviceable. The control system is responsive to the sensors to determine the time at which preheating of replacement side dams must be initiated prior to interrupting the cast for replacement of the side dams.

Figure 2:
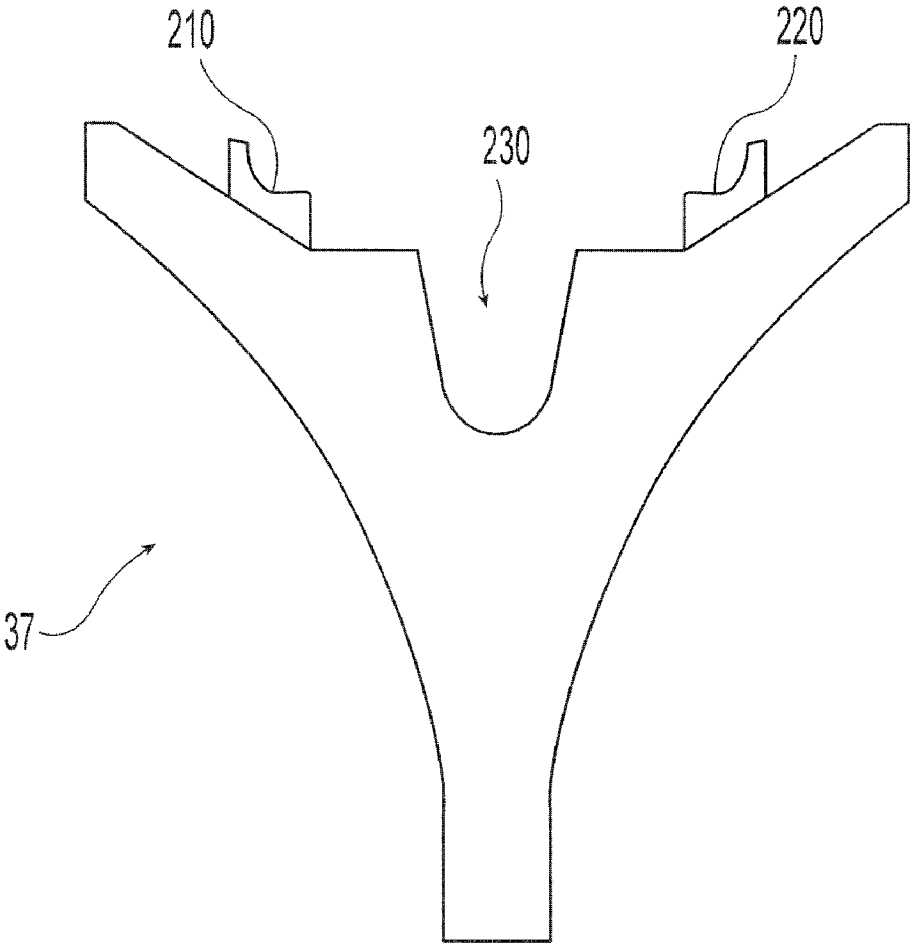
FIG. 2 illustrates an exemplary embodiment of a side dam holder, used in the system of FIGS. 1A-1G, in accordance with various aspects of the present invention.

FIG. 2 illustrates an exemplary embodiment of a side dam holder 37 for use in the continuous casting system. The side dam holder 37 is used in the system of FIGS. 1A-1G, in accordance with various aspects of the present invention. The side dam holder 37 includes three attachment portions 210, 220, and 230. In the embodiment shown in FIG. 2, the attachment portions 210, 220, and 230 are refractory notches or troughs (typically ceramic) that are capable of receiving and supporting a side dam without exposed portions of the side dam holder 37 extending substantially beyond an outer surface of the side dam adjacent the side dam holder.

Figure 3B:
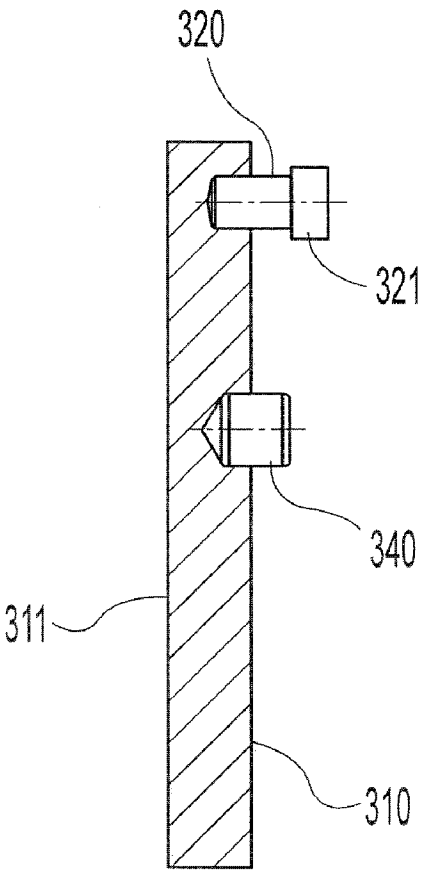
FIGS. 3A-3B illustrate an exemplary embodiment of a side dam, used in the system of FIGS. 1A-1G and held in place by the side dam holder of FIG. 2, in accordance with various aspects of the present invention.
Figure 3A:
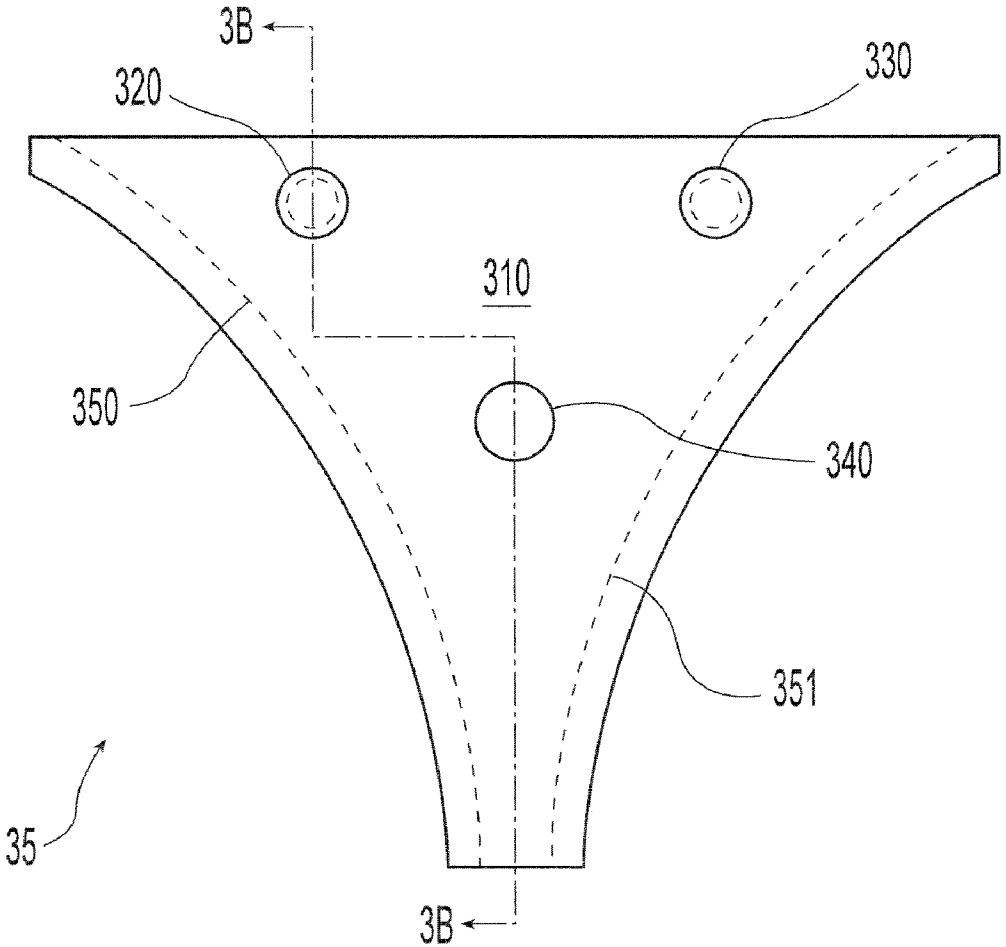

FIGS. 3A-3B illustrate an exemplary embodiment of a side dam 35, used in the system of FIGS. 1A-1G and held in place by the side dam holder 37 of FIG. 2, in accordance with various aspects of the present invention. The side dam 35 includes an outer surface 311 that faces the molten metal and an opposite outer surface 310 having three fastening portions 320, 330, and 340. FIG. 3A is a front view of the side dam 35 and FIG. 3B is a side view of the side dam 35. In accordance with an embodiment of the present invention, the fastening portions 320-340 are refractory fasteners (e.g., ceramic pins) which are held in place within holes in the side dam 35 by a refractory adhesive or glue. The refractory fasteners 320-340 extend outward from the opposite outer surface 310 of the side dam 35. Graphitized alumina, boron nitride and boron nitride-zirconia composites are examples of suitable refractory materials for the side dams. The dotted lines 350 and 351 of FIG. 3A serve to illustrate where the side dam 35 makes physical contact with the casting rolls when installed in a casting machine, in accordance with an embodiment of the present invention.

Alternatively, the side dam holder may have refractory attachment portions, which are usually ceramic, that extend into the fastening portions of the side dams (which are openings in the side dam), so that the exposed portions of the side dam holder do not extend substantially beyond the opposite outer side surface of the side dam toward the outer surface contacting the molten metal.

In accordance with an embodiment of the present invention, the refractory fasteners 320-340 of the side dam 35 and the attachment portions 210-230 of the side dam holder 37 interact to position the side dam 35 for casting when the side dam 35 is seated onto the side dam holder 37 such that the ceramic pins 320-340 rest within the troughs 210-230. The ceramic pins 320 and 330 each include an extension (e.g., a head) 321 which serve to help hold the side dam 35 secure to the side dam holder 37 at attachment portions 210 and 220. The extensions 321 hang over the attachment portions 210 and 220 such that the side dam 35 is limited in movement with respect to the side dam holder 37 in a direction perpendicular to the opposite outer surface 310 of the side dam 35. In accordance with an embodiment of the present invention, the fastening portions are refractory glued into the opposite outer surface 310 of the side dam 35.

Figure 4A:
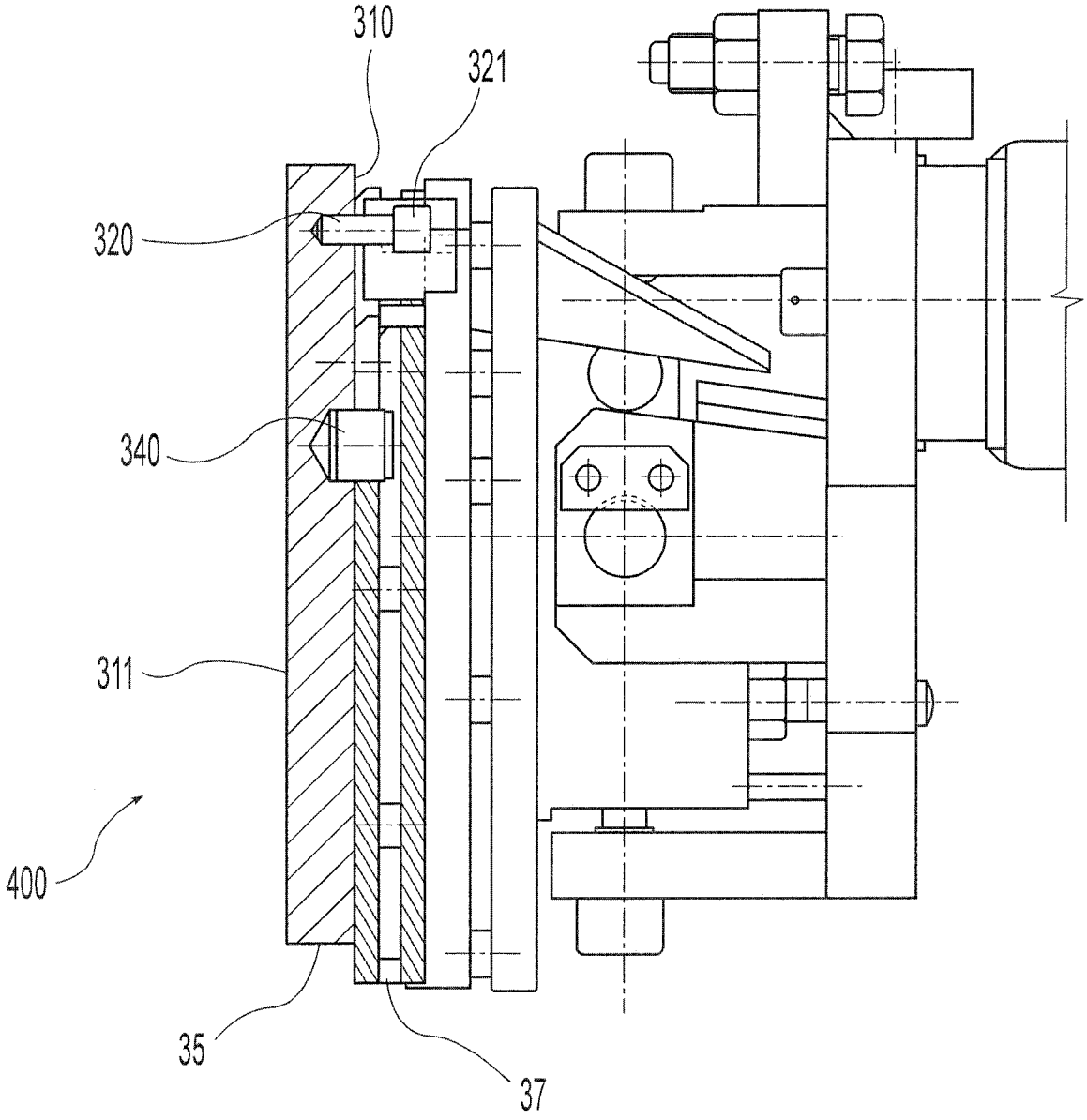
FIGS. 4A-4B illustrate an exemplary embodiment of a side dam assembly comprising the side dam holder of FIG. 2 and the side dam of FIGS. 3A-3B and used in the system of FIGS. 1A-1G, in accordance with various aspects of the present invention.
Figure 4B:
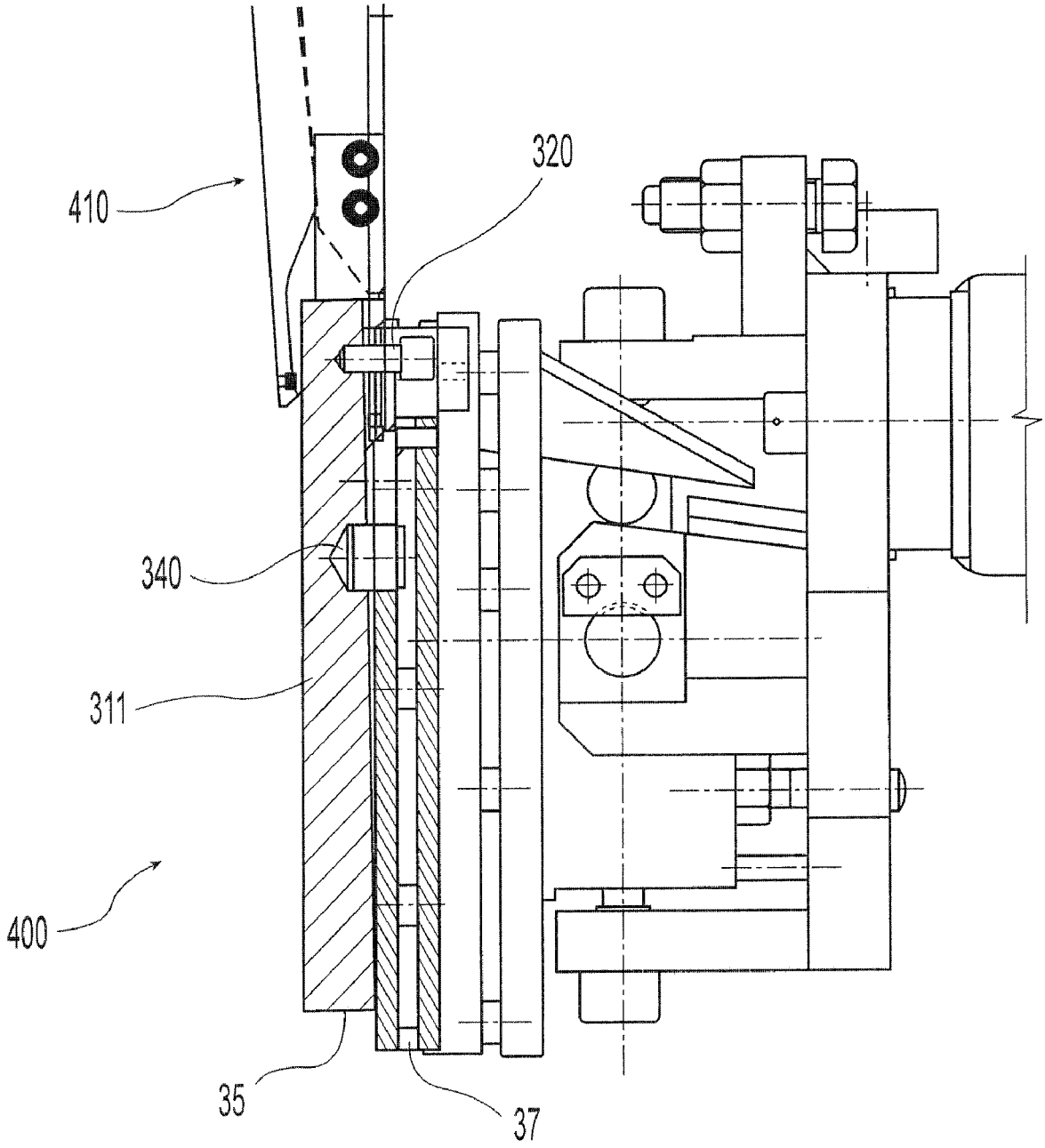

FIGS. 4A-4B illustrate an exemplary embodiment of a side dam assembly 400 comprising the side dam holder 37 of FIG. 2 seated with the side dam 35 of FIG. 3 and used in the system of FIGS. 1A-1G, in accordance with various aspects of the present invention. FIG. 4A shows the side dam assembly 400 at the cast position. FIG. 4B shows the side dam assembly 400 at installation using a transfer robot 410. The transfer robot 410 is able to extend downward, grab the side dam 35, and pull the side dam 35 upward to remove the side dam 35 from the side dam holder 37. Similarly, the transfer robot 410 is able to set a new side dam 35 down onto the side dam holder 37 as previously described herein. The transfer robot 410 does not have to be as precise in positioning the side dam 35 with respect to the side dam holder 37 as in prior art configurations. The configuration of the side dam 35 and side dam holder 37 is more forgiving with respect to positioning. Other machinery holds the side dam holder 37 in place.

In the cast position shown in FIG. 4A, the side dam 35 is positioned tightly against the side dam holder 37. No exposed portion of the side dam holder 37 extends substantially beyond the opposite outer surface 310 toward the outer surface 311 of the side dam 35 for contacting molten metal. Such a configuration allows for the side dam 35 to be used longer for casting and wear more before having to be replaced. Any or all of the fastening portions 320-340 may also be allowed to wear as the casting process proceeds, in accordance with various embodiments of the present invention.

A method of producing thin cast strip by continuous casting using the system of FIGS. 1A-1G with the side dam assembly of FIGS. 4A-4B may include steps of assembling a pair of casting rolls having a nip therebetween and assembling a metal delivery system comprising side dams adjacent the ends of the nip are assembled to confine a casting pool of molten metal supported on casting surfaces of the casting rolls, where each side dam has opposed outer surfaces, one said outer surfaces for contacting the molten metal and the opposite outer surface having fastening portions adapter to attach the side dam to a side dam holder to hold the side dams in place during casting. The side dam holder may be configured without circumferentially exposed portions extending beyond the opposite outer surface of the side dam having the fastening portions toward the outer surface for contacting the molten metal. Then, introducing molten steel between the pair of casting rolls to form a casting pool supported on casting surfaces of the casting rolls confined by the side dams, counter-rotating the casting rolls to form solidified shells on the surfaces of the casting rolls, and casting thin steel strip through the nip between the casting rolls from the solidified shells.

In accordance with an embodiment of the present invention, the wear of at least portions of the side dams is monitored. The monitoring is performed by a sensor such as, for example, an optical sensor or an electrical sensor. At least a portion of a side dam is replaced when the sensor reveals that the side dam is worn to specified limits.

In summary, certain embodiments of the present invention provide a side dam assembly for a continuous twin roll caster system. The side dam assembly includes a side dam having an outer surface toward the molten metal and an opposite outer surface having fastening portions extending outward from the opposite outer surface and capable of attaching the side dam to a side dam holder at the opposite outer surface, to hold the side dam in place during casting. The said dam assembly also includes a side dam holder having attachment portions capable of receiving and supporting the side dam at the fastening portions, without any portion of the side dam holder extending substantially beyond the opposite outer surface toward the outer surface of the side dam for contacting molten metal.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiments disclosed, but that the invention will include all embodiments falling within the scope of the appended claims.

What is claimed is:

1. In a continuous twin roll caster system, a side dam assembly comprising:

a side dam of refractory material having opposed outer surfaces, one said outer surface for contacting molten metal and the opposite outer surface having fastening portions adapted to attach said side dam to a side dam holder to hold the side dam in place during casting; and a side dam holder having attachment portions adapted to receive and support said side dam at said fastening portions, without circumferentially exposed portions of said side dam holder extending beyond said opposite outer surface of the side dam toward the outer surface for contacting molten metal.

2. The continuous twin roll caster system having a side dam assembly as claimed in claim 1 where said fastening portions of said side dam comprise refractory fasteners extending from said opposite outer surface adjacent to said side dam holder.

3. The continuous twin roll caster system having a side dam assembly as claimed in claim 2 where said refractory fasteners of said side dam and said attachment portions of said side dam holder interact to position said side dam for casting.

4. The continuous twin roll caster system having a side dam assembly as claimed in claim 1 where said fastening portions of said side dam comprise at least three refractory pins which are attached into the side dam at the opposite outer surface of said side dam.

5. The continuous twin roll caster system having a side dam assembly as claimed in claim 1 where said attachment portions of said side dam holder comprise notches or troughs in which said fastening portions of said side dam rest when said side dam is attached to said side dam holder.

6. The continuous twin roll caster system having a side dam assembly as claimed in claim 1 where the attachment portions of the side dam holder extend into fastening portions which are openings in the side dam, to provide that circumferentially exposed portions of the side dam holder do not extend substantially beyond the opposite outer surface of the side dam toward the outer surface contacting the molten metal.

7. The continuous twin roll caster system having a side dam assembly as claimed in claim 6 where said attachment portions of the side dam holder extending into the side dam are ceramic.

8. In a continuous twin roll caster system, a side dam assembly comprising:

a side dam of refractory material having opposed outer surfaces with one said outer surface for contacting molten metal and the opposite outer surface having refractory pins extending outward from said opposite outer surface and capable of attaching said side dam to a side dam holder to position and hold said side dam in place during casting; and a side dam holder having notches capable of receiving and supporting said side dam by said refractory pins, without circumferentially exposed portions of said side dam holder extending substantially beyond said opposite outer surface of said side dam in the direction of the outer surface for contacting molten metal.

9. The continuous twin roll caster system having a side dam assembly as claimed in claim 8 where at least three refractory pins of said side dam and at least three notches or troughs of said side dam holder interact to position and support said side dam during casting.

10. The continuous twin roll caster system having a side dam assembly as claimed in claim 8 where refractory pins are refractory glued into said opposite outer surface of said side dam.

11. The continuous twin roll caster system having a side dam assembly as claimed in claim 8 where said refractory pins of said side dam rest on said notches of said side dam holder when said side dam is attached to said side dam holder.

12. The continuous twin roll caster system having a side dam assembly as claimed in claim 8 where at least some of the refractory pins of said side dam include an extension to assist holding said side dam in place with respect to said side dam holder.

13. A side dam for use in a continuous twin roll caster system, said side dam of refractory material having opposed outer surfaces with one outer surface for contacting molten metal and casting rolls and an opposite outer surface having fastening portions of refractory material extending outward from said opposite outer surface and adapted to attach said side dam to a side dam holder to hold said side dam in place during casting.

14. The side dam for use in a continuous twin roll caster system as claimed in claim 13 where said fastening portions of said side dam are capable of interacting with attachment portions of said side dam holder to position and support the side dam when said side dam is positioned during casting.

15. The side dam for use in a continuous twin roll caster system as claimed in claim 13 where said fastening portions of said side dam comprise refractory pins which are refractory glued into said opposite outer surface of said side dam.

16. The side dam for use in a continuous twin roll caster system as claimed in claim 13 where said fastening portions of said side dam are capable of resting in notches of said side dam holder when said side dam is attached to said side dam holder.

17. A side dam holder for use in a continuous twin roll caster system, said side dam holder having attachment portions adapted to receive and support a refractory side dam at fastening portions of refractory material, and without circumferentially exposed portions of said side dam holder extending beyond an outer surface of said side dam for contacting molten metal.

18. The side dam holder for use in a continuous twin roll caster system as claimed in claim 17 where said attachment portions of said side dam holder are capable of interacting with said fastening portions of said side dam to position said side dam for casting.

19. The side dam holder for use in a continuous twin roll caster system as claimed in claim 17 where said attachment portions of said side dam holder comprise notches capable of receiving said fastening portions of said side dam when said side dam is attached to said side dam holder.

* * * * *

UNITED STATES PATENT AND TRADEMARK OFFICE

CERTIFICATE OF CORRECTION

PATENT NO. : 7,556,084 B2
APPLICATION NO. : 11/277414
DATED : July 7, 2009
INVENTOR(S) : Bowman et al.

It is certified that error appears in the above-identified patent and that said Letters Patent is hereby corrected as shown below:

Column 4, line 45
delete "enclosure"
insert --enclosures--

Column 4, line 59
delete "dames"
insert --dams--

Column 4, line 66
delete "surface"
insert --surfaces--

Column 7, line 16
delete "side dams 35 40"
insert --side dams 35'--

Column 8, line 63
delete "adapter"
insert --adapted--

Signed and Sealed this

Sixteenth Day of March, 2010

David J. Kappos

David J. Kappos
*Director of the United States Patent and Trademark Office*